US011369814B2

(12) United States Patent
Thompson et al.

(10) Patent No.: US 11,369,814 B2
(45) **Date of Patent: *Jun. 28, 2022**

(54) REGULATOR BUTTON COVER DEVICE

(71) Applicant: The Government of the United States of America, as represented by the Secretary of Homeland Security, Washington, DC (US)

(72) Inventors: William G. Thompson, Elizabeth City, NC (US); Mary Shalane Regan, Groton, CT (US)

(73) Assignee: The Government of the United States of America, as represented by the Secretary of Homeland Security, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/541,100

(22) Filed: Dec. 2, 2021

(65) Prior Publication Data

US 2022/0134146 A1 May 5, 2022

Related U.S. Application Data

(63) Continuation of application No. 17/245,867, filed on Apr. 30, 2021, now Pat. No. 11,219,789.

(60) Provisional application No. 63/110,157, filed on Nov. 5, 2020.

(51) Int. Cl.

| | |
|---|---|
| ***A62B 25/00*** | (2006.01) |
| ***A62B 9/06*** | (2006.01) |
| ***B63C 11/18*** | (2006.01) |
| ***B63C 11/22*** | (2006.01) |

(52) U.S. Cl.
CPC ..... *A62B 25/00* (2013.01); *A62B 9/06* (2013.01); *B63C 11/186* (2013.01); *B63C 11/2227* (2013.01)

(58) Field of Classification Search
CPC ..... A62B 25/00; A62B 9/06; B63C 11/186; B63C 11/2227
See application file for complete search history.

(56) References Cited

U.S. PATENT DOCUMENTS

| | | | |
|---|---|---|---|
| 4,079,735 | A | 3/1978 | Gaffney |
| 4,460,089 | A | 7/1984 | Abbott |
| 4,996,982 | A | 3/1991 | Williamson |
| D358,640 | S | 5/1995 | Dreyfus |
| D358,881 | S | 5/1995 | Krupansky |
| D504,946 | S | 5/2005 | Silverwood |
| D545,958 | S | 7/2007 | Williamson |
| 2016/0095990 | A1 | 4/2016 | Smutney et al. |

*Primary Examiner* — Timothy A Stanis
(74) *Attorney, Agent, or Firm* — Lavanya Ratnam; Kelly G. Hyndman; Robert W. Busby

(57) ABSTRACT

A cover device for a regulator, which has a purge button and a mouthpiece connected to the regulator, includes a body having a mouthpiece housing to receive the mouthpiece through an access opening which presents a friction fit to squeeze the mouthpiece passing therethrough in a squeezed state to enter and exit a hollow interior of the mouthpiece housing. The hollow interior is configured to store the mouthpiece in a relaxed state. A button cover is connected to the mouthpiece housing to cover the purge button on a top surface of the regulator when the mouthpiece is inserted into the hollow interior of the mouthpiece housing. The button cover is narrower in width than the mouthpiece housing.

20 Claims, 12 Drawing Sheets

REGULATOR BUTTON COVER DEVICE

CROSS-REFERENCE TO RELATED APPLICATIONS

The application is a continuation of U.S. patent application Ser. No. 17/245,867, filed Apr. 30, 2021, entitled REGULATOR COVER FOR FLIGHT VEST, which is a nonprovisional of and claims the benefit of priority from U.S. Provisional Patent Application No. 63/110,157, filed on Nov. 5, 2020, entitled REGULATOR COVER FOR FLIGHT VEST, the entire disclosures of which are incorporated herein by reference.

SUMMARY STATEMENT OF GOVERNMENT INTEREST

The present invention was made by employees of the United States Department of Homeland Security in the performance of their official duties. The U.S. Government has certain rights in this invention.

FIELD

The discussion below relates generally to systems and methods of preventing unintentional activation of a regulator for an emergency breathing device.

BACKGROUND

Emergency air supply devices are used to assist crew members or passengers in making an emergency egress from a submerged aircraft. The emergency breathing device has a very limited amount of air. Accidental or unnecessary activations of the device can deplete the air supply and render the device useless during an emergency.

SUMMARY

Embodiments of the present invention are directed to apparatuses and methods for protecting the purge button of a second stage regulator of an emergency breathing device (EBD) to prevent accidental purging in a simple, reliable, and effective manner. In one embodiment, a regulator cover device is a single-piece hard member that protects both the mouthpiece and the purge button of the second stage regulator, eliminating the need for a separate mouthpiece cover. Protecting this purge button prevents the wearer of the flight vest from accidentally or inadvertently bleeding down the EBD bottle during routine flight operations and rendering it unusable in an actual underwater entrapment or egress emergency.

An aspect is directed to a cover device for a regulator which has a purge button and a mouthpiece connected to the regulator. The cover device comprises a body having a proximal portion and a distal portion, a base extending from the proximal portion to the distal portion, a proximal end wall, a proximal top, two side walls spaced from one another in a width direction on two sides of the body and connected to the base, the proximal top, and the proximal end wall, and a distal top connected to the proximal top and being at a greater height than the proximal top relative to the base and being narrower in width than the proximal top. The base in the proximal portion, the proximal end wall, the proximal top, and the two side walls define a hollow interior of the body in the proximal portion. The two side walls each include an internal enlarged portion at a location between the proximal portion and the distal portion to form a narrowed region of the hollow interior in the width direction providing a narrowed access to the hollow interior. The proximal portion is sized to receive the mouthpiece into the hollow interior. The narrowed region of the hollow interior between the internal enlarged portions of the two side walls presents a friction fit for the mouthpiece entering and exiting the hollow interior of the proximal portion. The base in the distal portion is configured to support the regulator. The distal top extends from the proximal top with a sufficient length and having a sufficient width to cover the purge button of the regulator when the mouthpiece is inserted into the hollow interior of the proximal portion of the body, while exposing a portion of the regulator surrounding the purge button.

Another aspect is directed to a cover device for a regulator which has a purge button and a mouthpiece connected to the regulator. The cover device comprises a body which includes: a mouthpiece housing to receive the mouthpiece through an access opening which presents a friction fit to squeeze the mouthpiece passing therethrough in a squeezed state to enter and exit a hollow interior of the mouthpiece housing, the hollow interior being configured to store the mouthpiece in a relaxed state; a regulator support connected to the mouthpiece housing to support a bottom surface of the regulator when the mouthpiece is inserted into the hollow interior of the mouthpiece housing; and a button cover connected to the mouthpiece housing to cover the purge button on a top surface of the regulator when the mouthpiece is inserted into the hollow interior of the mouthpiece housing, while exposing a portion of the top surface of the regulator surrounding the purge button.

Another aspect is directed to a method for covering a regulator which has a purge button and a mouthpiece connected to the regulator, using a cover device which includes a body having a mouthpiece housing to receive the mouthpiece through an access opening which presents a friction fit to squeeze the mouthpiece passing therethrough in a squeezed state to enter and exit a hollow interior of the mouthpiece housing, the hollow interior being configured to store the mouthpiece in a relaxed state; a regulator support connected to the mouthpiece housing to support a bottom surface of the regulator when the mouthpiece is inserted into the hollow interior of the mouthpiece housing; and a button cover connected to the mouthpiece housing. The method comprises: inserting the mouthpiece into the hollow interior of the mouthpiece housing of the body by squeezing the mouthpiece from an open state to a collapsed state via a friction fit through the access opening to the hollow interior and allowing the mouthpiece to expand to the open state in the hollow interior of the mouthpiece housing; and supporting the regulator with the regulator support and covering the purge button on a top surface of the regulator with the button cover which extends from the mouthpiece housing with a sufficient length and has a sufficient width to cover the purge button of the regulator.

Other features and aspects of various embodiments will become apparent to those of ordinary skill in the art from the following detailed description which discloses, in conjunction with the accompanying drawings, examples that explain features in accordance with embodiments. This summary is not intended to identify key or essential features, nor is it intended to limit the scope of the invention, which is defined solely by the claims.

BRIEF DESCRIPTION OF THE DRAWINGS

The attached drawings help explain the embodiments described below.

DETAILED DESCRIPTION

Overview

Figure 1:
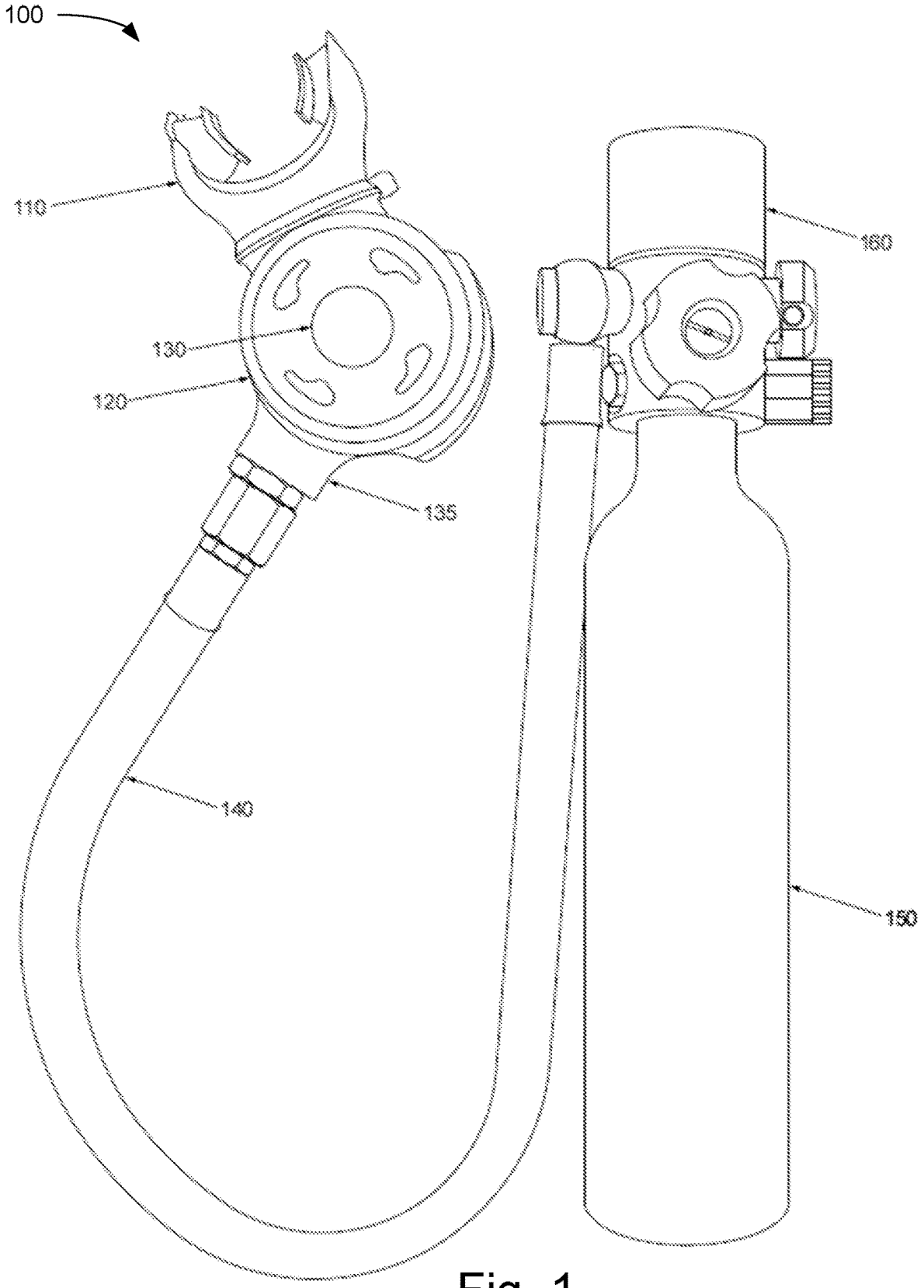
FIG. 1 shows an example of an emergency breathing device (EBD).

FIG. 1 shows an example of an EBD. One specific device is a Survival Egress Air System-1 (SEAS-1) device 100 which is designed for use only as an emergency device to assist a trained U.S. Coast Guard crew member or passenger in making an emergency egress from a submerged aircraft. A mouthpiece 110 is coupled to a regulator 120 which has an activation button 130. The regulator 120 is connected via a hose connection 135 to a medium pressure (MP) hose 140 which is connected to an air tank or bottle or cylinder 150. The regulator 120 is a second stage regulator at one end of the hose 140 and a first stage regulator 160 is at the other end of the hose 140. The second stage regulator 120 contains a mechanism that reduces the intermediate pressure in the 140 hose coming from the first stage regulator 160 to the surrounding water pressure, making it comfortable and easy to breathe. The activation button 130 is a second stage purge button which can be pressed or activated briefly to ensure that sufficient airflow is provided to clear the second stage regulator 120 of water.

Figure 2:
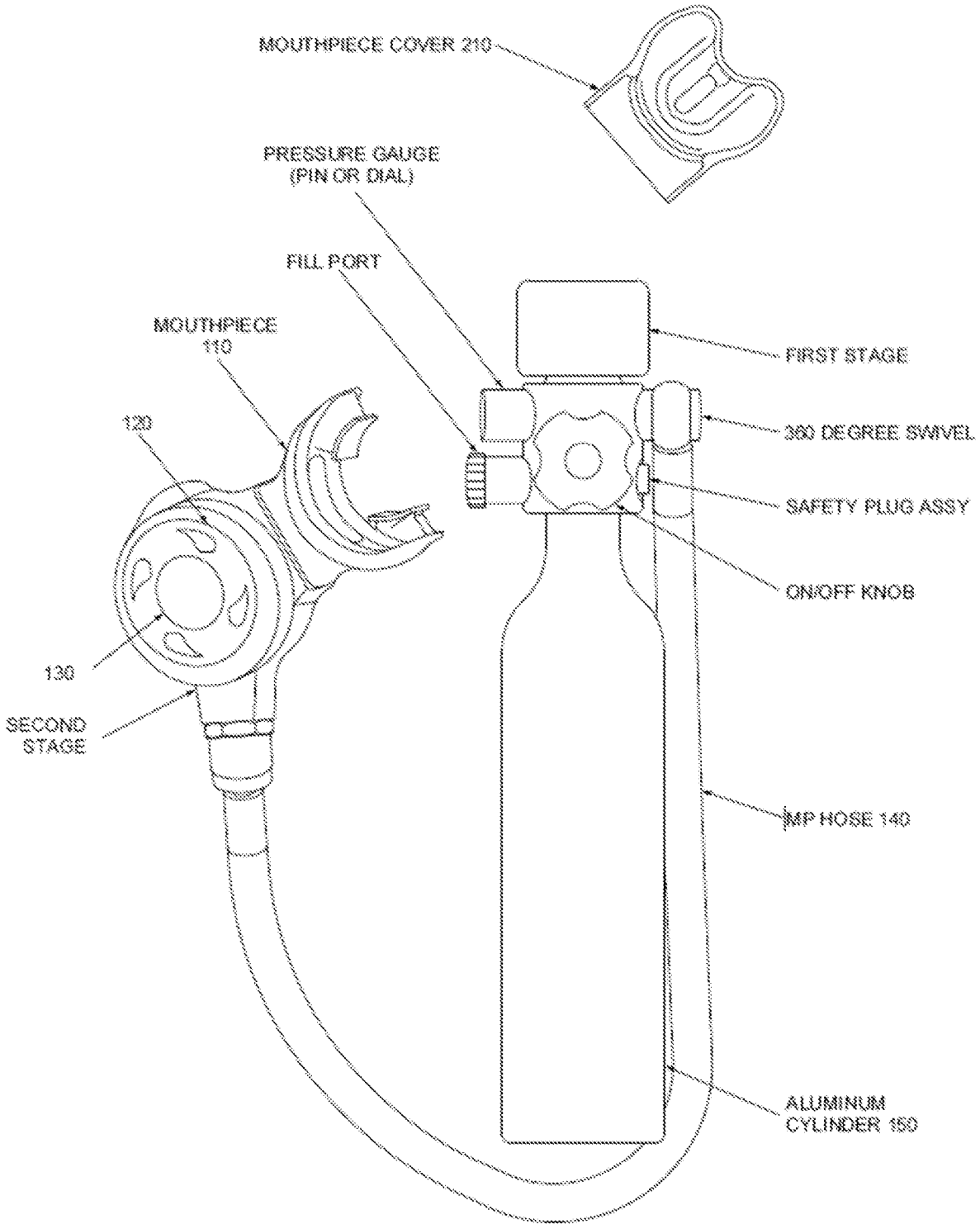
FIG. 2 shows additional details of the EBD 100 of FIG. 1.

FIG. 2 shows additional details of the EBD 100 of FIG. 1. The SEA system is specifically designed for use on a variety of aircrew flight vests and harnesses typically used in maritime environments. A lightweight cylinder 150 with integrated regulator (first stage regulator 160 and second stage regulator 120) provides a source of emergency breathing air to allow crew members or passengers to safely egress from a submerged aircraft. A mouthpiece cover 210 can be used to cover the mouthpiece 110 for protection and sanitation.

In a procedure to test the SEA device 100, a subjective breathing test is performed to ensure the second stage is operating properly by (i) fully depressing the purge button 130 to ensure an adequate volume of air passes through the second stage to clear out any water; and (ii) inhaling slowly but deeply from the mouthpiece 110. A properly serviced and adjusted regulator should deliver air upon deep inhalation without excessive inhalation effort, free-flow or fluttering of the second stage diaphragm disposed below the purge button 130.

It is advisable not to press the second stage purge button 130 repeatedly when the SEA device 100 is pressurized during pre-flight inspection. Unnecessary purging of the SEA device 100 will deplete air from the cylinder 150, which will then have to be topped off by maintenance personnel. While industry standards protect the mouthpiece 110 using the mouthpiece cover 210, they do not protect the purge button 130 from accidental purging.

EMBODIMENTS

A number of examples or embodiments of the present invention are described, and it should be appreciated that the present invention provides many applicable inventive concepts that can be embodied in a variety of ways. The embodiments discussed herein are merely illustrative of ways to make and use the invention and are not intended to limit the scope of the invention. Rather, as will be appreciated by one of skill in the art, the teachings and disclosures herein can be combined or rearranged with other portions of this disclosure along with the knowledge of one of ordinary skill in the art.

Figure 3:
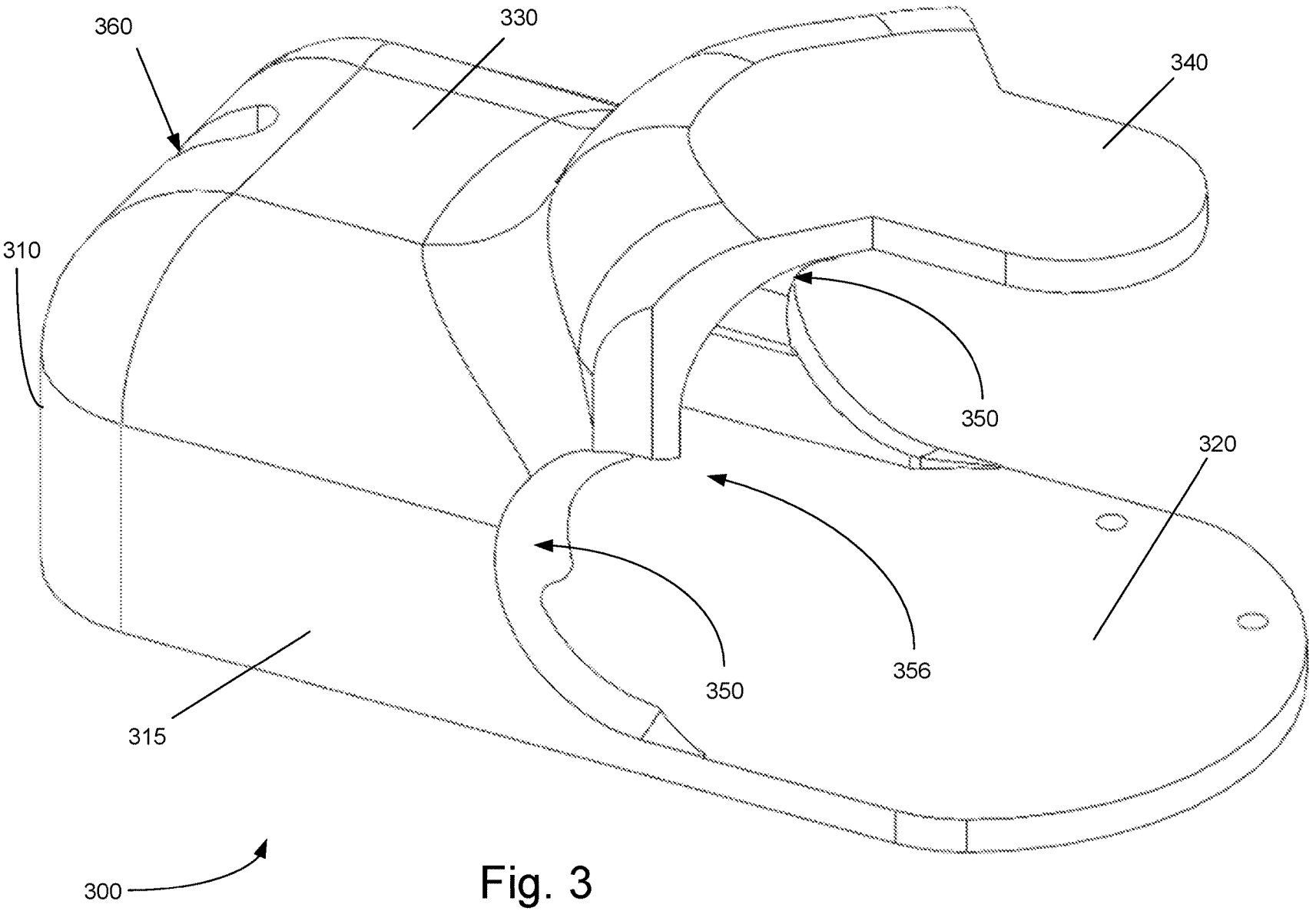
FIG. 3 is a perspective view from a distal end of a regulator cover device according to an embodiment.
Figure 4:
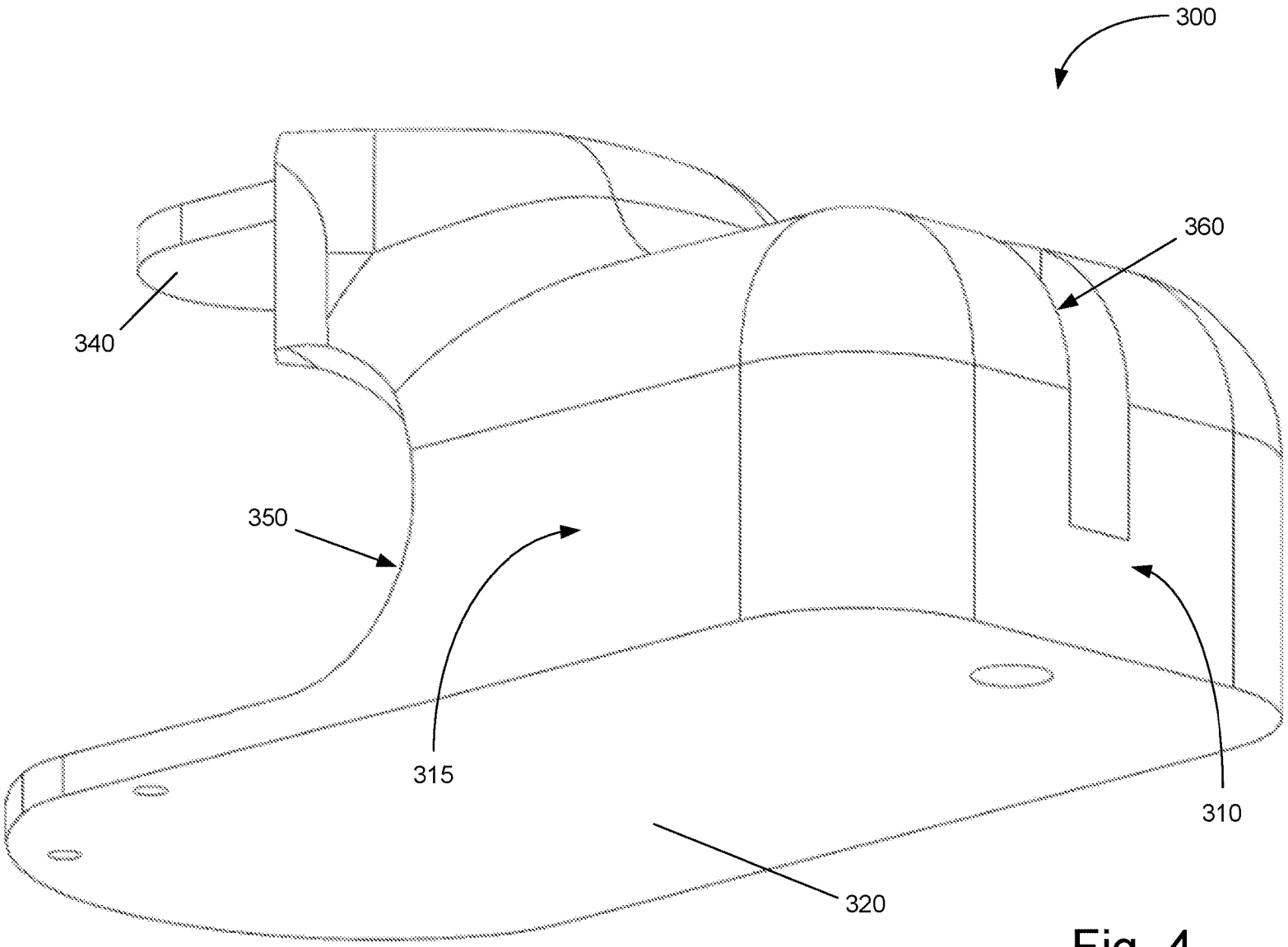
FIG. 4 is a perspective view from a proximal end of the regulator cover device of FIG. 3.
Figure 5:
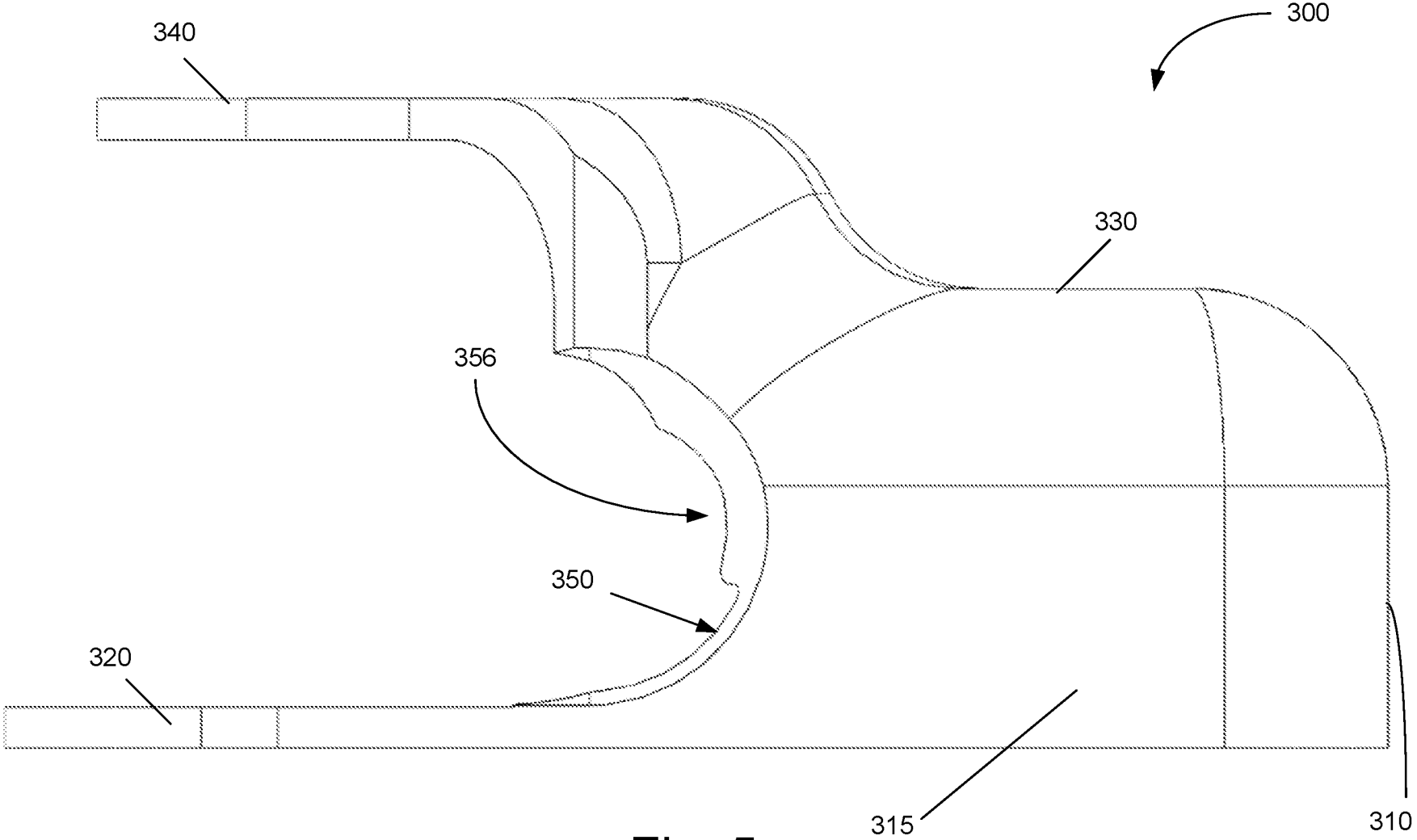
FIG. 5 is a side elevational view of the regulator cover device of FIG. 3.

FIG. 3 is a perspective view from a distal end of a regulator cover device according to an embodiment. FIG. 4 is a perspective view from a proximal end of the regulator cover device of FIG. 3. FIG. 5 is a side elevational view of the regulator cover device of FIG. 3. In this embodiment, the regulator cover device 300 includes a single-piece hard body or housing having a distal portion and a proximal portion with a hollow interior. It may be made of a hard or nondeformable plastic, metal, composite material, or the like. The single-piece body is simple in construction and can be made easily and inexpensively.

In this embodiment, the proximal portion has a proximal end wall 310, two side walls 315, a base or bottom 320 which extends from the proximal portion to the distal portion, and a proximal top 330. The two side walls 315 are spaced from one another in a width direction on two sides of the body. The side walls 315 are connected to the base 320, the proximal top 330, and the proximal end wall 310. In the distal portion, a distal top 340 is spaced above the base 320. The two side walls 315 may extend from the proximal end wall 310 along the proximal portion of the body in a distal direction toward the distal portion of the body. The side walls 315 end at an intersection between the proximal portion and the distal portion, at side wall cut-outs or side cut-outs 350 which may be curved concave in shape and disposed between the base 320 and the proximal top 330. As such, the side cut-outs 350 are located between the end of the distal top (button cover) 340 and the proximal end of the regulator support (the base 320 between the proximal portion and the distal portion). The proximal portion provides a hollow interior, which is defined by the base 320, proximal end wall 310, side walls 315, and proximal top 330 and which has an access opening 356 between the proximal portion and the distal portion. In contrast, the distal portion has open sides between the base 320 and the distal top 340.

The distal top 340 may be at a greater height than the proximal top 330 relative to the base 320 and have a narrower width than the proximal top 330. The distal top 340 may be narrower in width than the base 320 in the distal portion (i.e., regulator support) and is shorter in length than the base 320 in the distal portion in the distal direction extending from the proximal portion (i.e., mouthpiece housing) of the body away from the proximal end wall 310. In one example, the base 320 in the distal portion (i.e., regulator support) has a proximal end connected to the base 320 in the proximal portion (i.e., mouthpiece housing) below the access opening 356 (integrally as a continuous base or at a connection between separate base portions). The regulator support has a distal end which may generally match the bottom surface of the regulator 120 in width. The distal top 340 has a proximal end connected to the proximal top 330 above the access opening 356 and narrows in width from the proximal end to a distal end. The distal top 340 may generally match the purge button 130 in width to cover the purge button 130 while exposing portions of the regulator 120 on a distal side which is distal of the purge button 130 and on two sides of the purge button 130 between the proximal end and the distal end of the distal top 340.

The distal top 340 may have a convex shaped distal end that may be semicircular in shape generally matching the shape of the purge button 130. When the mouthpiece 110 is inserted into the hollow interior of the proximal portion or mouthpiece housing, the distal top 340 serves as a button cover for the purge button 130 to prevent accidental activation thereof. The base 320 in the distal portion serves as a regulator support connected to the mouthpiece housing for supporting a bottom surface of the regulator 120. It may be spaced from the distal top 340 by a distance which is approximately equal to a height of the regulator 120 between the bottom surface of the regulator and a top surface of the regulator which includes the purge button 130. The distance may be slight larger than the height of the regulator 120 (e.g., larger by about 10%, or about 5%, or about 2%). In this way, the regulator 120 is constrained to keep the purge button covered by the distal top (i.e., button cover) 340.

A proximal slot 360 extends along the height direction at the proximal end wall 310. As best seen in FIG. 4, the proximal slot 360 extends from a location above the base 320 (e.g., about halfway between the base 320 and the proximal top 330) across the upper part of the proximal end wall 310 to the proximal top 330.

Figure 6:
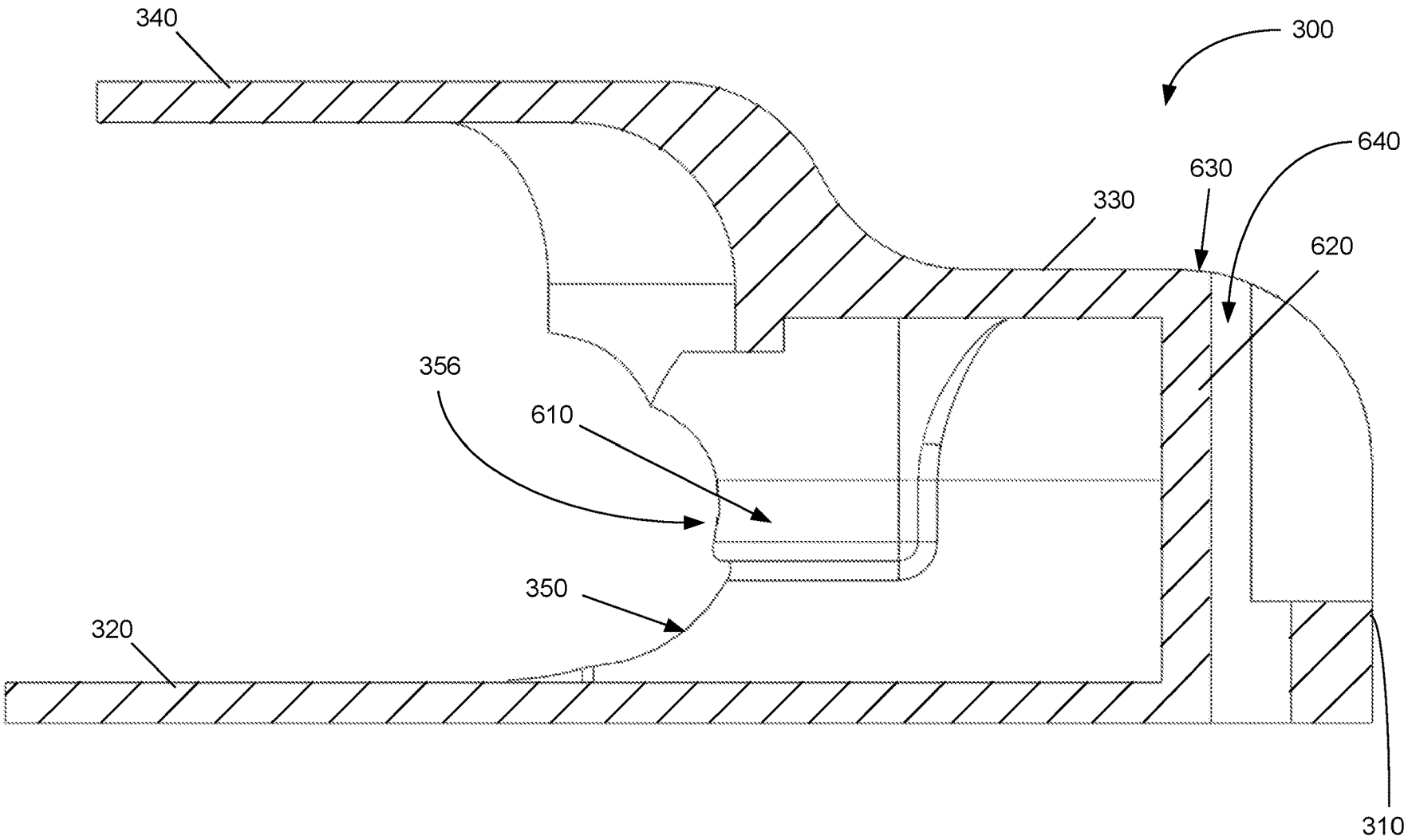
FIG. 6 is a side cross-sectional view of the regulator cover device of FIG. 3.
Figure 7:
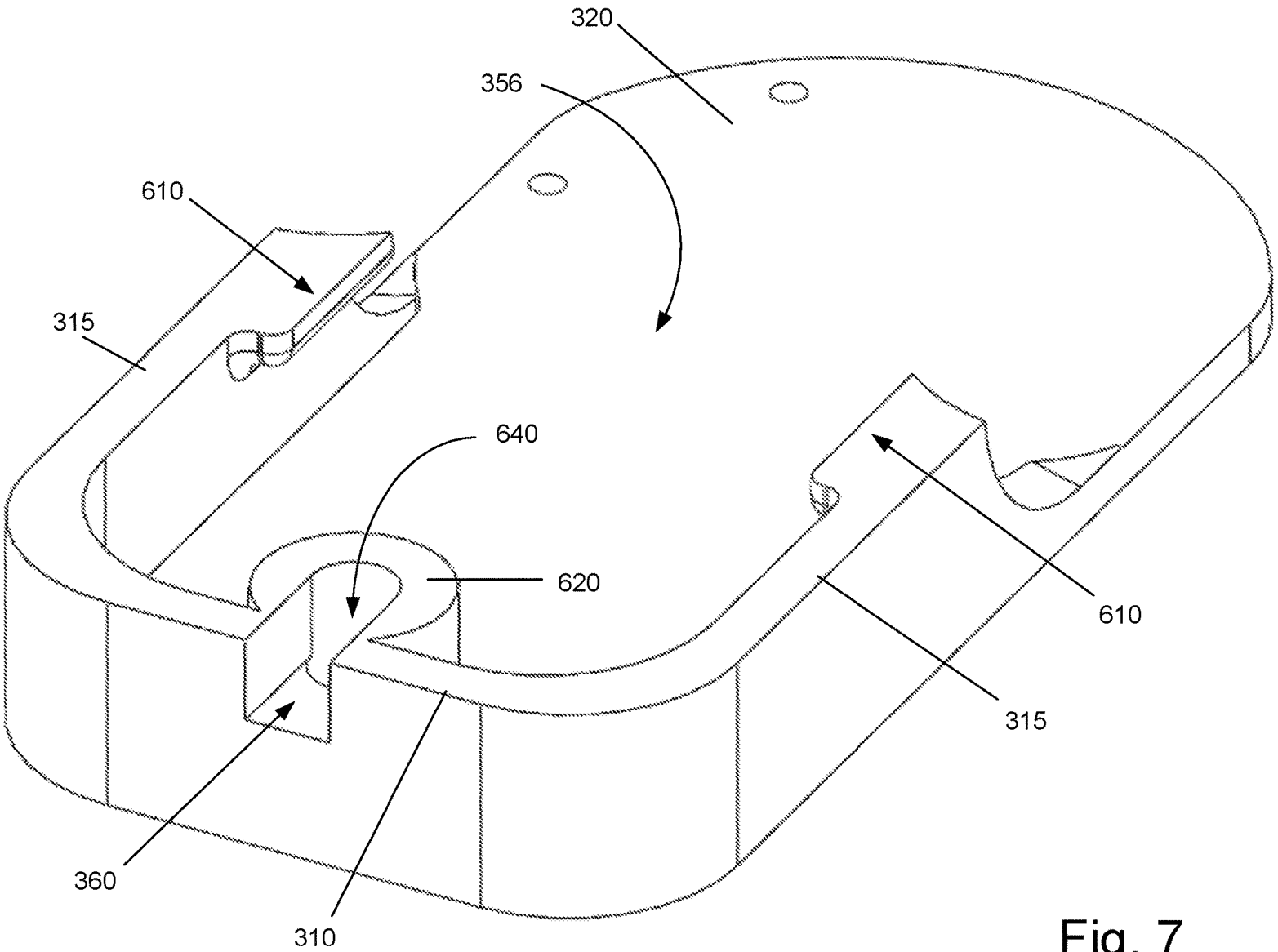
FIG. 7 is a perspective cross-sectional view of a lower part of the regulator cover device of FIG. 3 without the proximal top and distal top.
Figure 8:
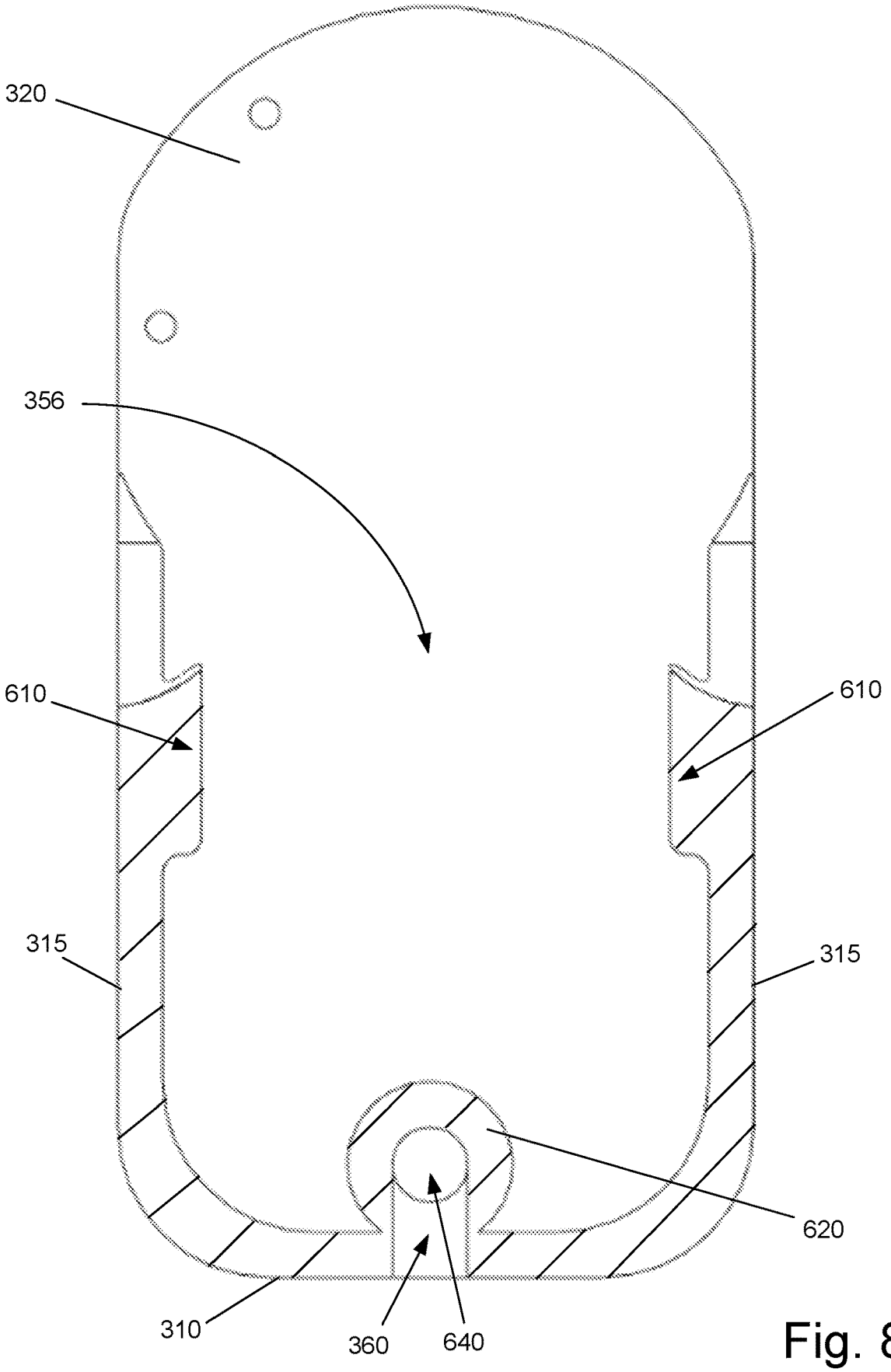
FIG. 8 is a top cross-sectional view of the lower part of the regulator cover device of FIG. 7.
Figure 9:
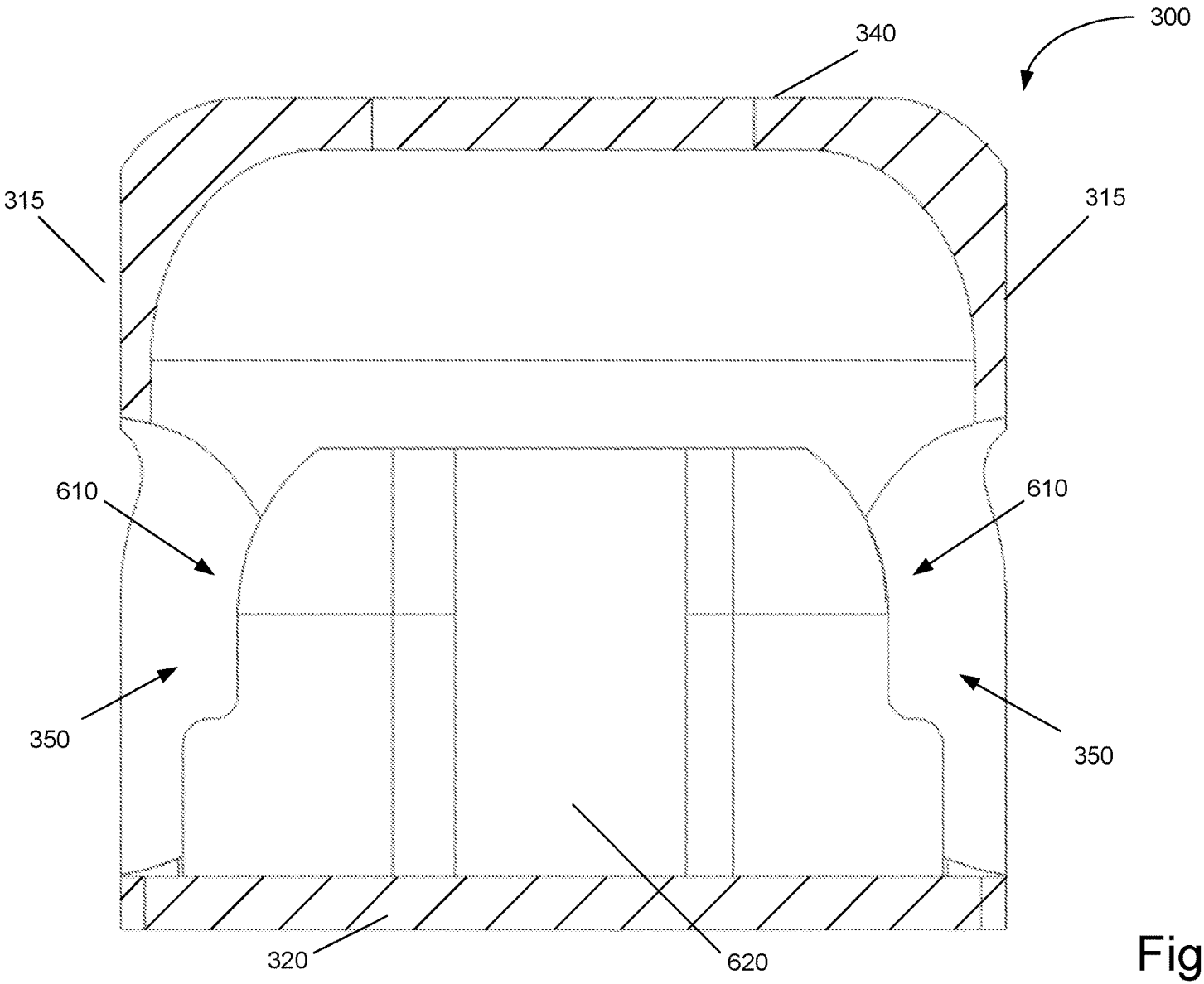
FIG. 9 is an elevational view from a distal end of the regulator cover device of FIG. 3.
Figure 10:
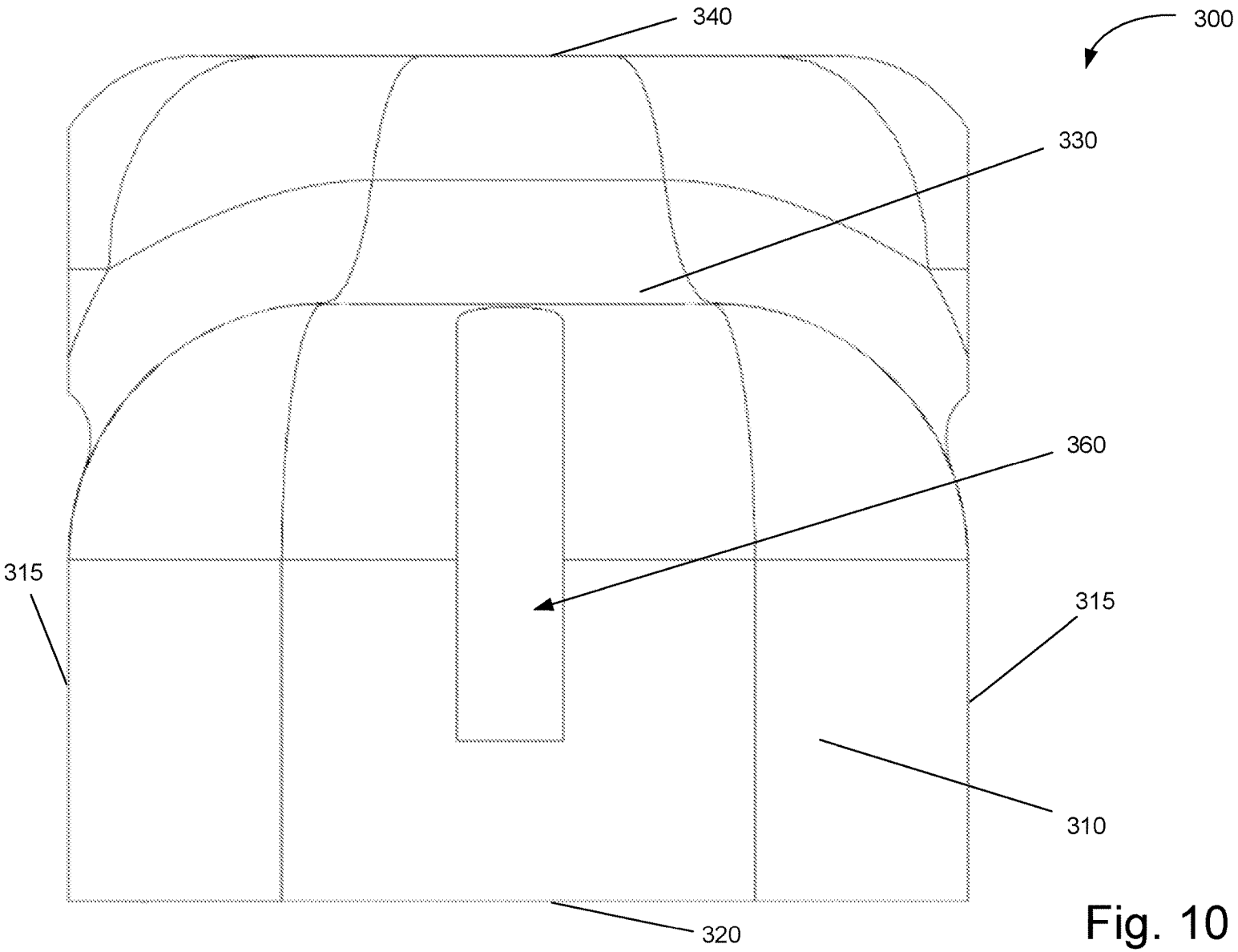
FIG. 10 is an elevational view from a proximal end of the regulator cover device of FIG. 3.
Figure 11:
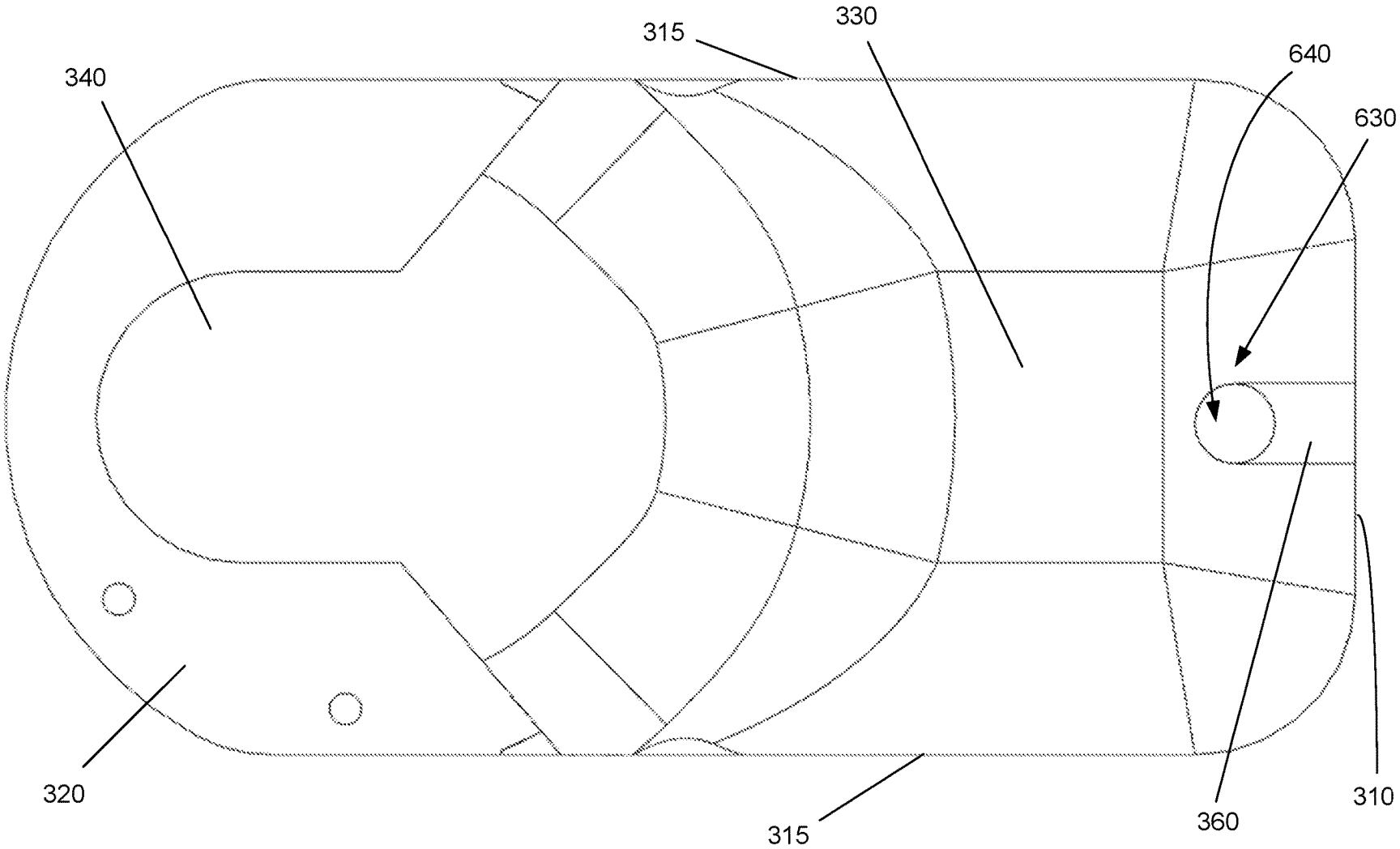
FIG. 11 is a top plan view of the regulator cover device of FIG. 3.

FIG. 6 is a side cross-sectional view of the regulator cover device 300 of FIG. 3. FIG. 7 is a perspective cross-sectional view of a lower part of the regulator cover device of FIG. 3 without the proximal top 330 and distal top 340. FIG. 8 is a top cross-sectional view of the lower part of the regulator cover device of FIG. 7. FIG. 9 is an elevational view from a distal end of the regulator cover device of FIG. 3. FIG. 10 is an elevational view from a proximal end of the regulator cover device of FIG. 3. FIG. 11 is a top plan view of the regulator cover device of FIG. 3.

At a location between the proximal portion and the distal portion, internal enlarged portions 610 of the two side walls 315 create a narrowing of the hollow interior in the width direction to form a narrowed access opening 356 to the hollow interior in the proximal portion. The narrowing of the hollow interior presents a friction fit for the mouthpiece 110 entering and exiting the hollow interior of the proximal portion. For instance, the mouthpiece 110 may be squeezed from an open state or relaxed state to a squeezed state or collapsed state as it is friction fitted through the neck region between the internal enlarged portions 610 of the side walls 315 and then is allowed to reopen or expand on either side of the neck region. The hollow interior in the proximal portion (i.e., mouthpiece housing) is sized to receive and store the mouthpiece in the reopened, relaxed state.

The proximal slot 360 leads to and exposes a proximal column 620 at the proximal end wall 310. The proximal column 620 is spaced from the access opening 356 and spaced from the proximal end wall 310. It extends from the base 320 to a proximal column top 630. A proximal column hole 640 is provided through a length of the proximal column 620 between the base 320 at the bottom of the proximal column 620 and the proximal column top 630. The proximal column hole 640 is disposed at a height below the proximal top 330 relative to the base 320 and is in communication with the proximal slot 360. In one embodiment, the proximal slot 360 is cut out of portions of the proximal end wall 310 and the proximal top 330 (i.e., cut into the hollow interior) to expose the proximal column hole 640 at the proximal column top 630. An attachment line such as a zip tie or wrap tie can be inserted through the proximal slot 360 and the proximal column hole 640. The two ends of the attachment line can then be used (e.g., tied together) to attach the regulator cover device 300 to an object or garment such as a flight vest.

The regulator cover device 300 is configured to cover both the mouthpiece 110 and the purge button 130 on the second stage regulator 120, thereby eliminating the need for the mouthpiece cover 210 of FIG. 2. The mouthpiece 110 is inserted into the hollow interior of the proximal portion of the regulator body between the base 320 and the proximal top 330. The mouthpiece 110 may be made of a soft material such as rubber while the regulator cover device 300 may be made of a hard or nondeformable plastic or the like. In one example, the mouthpiece 110 is friction fitted between the side walls 315. The friction fit can be enhanced by the narrowing of the hollow interior created by the internal enlarged portions 610 of the two side walls 315 at the location between the proximal portion and the distal portion. The hollow interior of the proximal portion serves as a mouthpiece housing for the mouthpiece 110.

The regulator 120 is disposed in the distal portion of the body of the regulator cover device 300 between the base 320 and the distal top 340. The distal top 340 does not entirely cover the regulator 120 but only needs to be sufficiently wide and long to cover the purge button 130 on the regulator 120 to prevent accidental pressing or activation of the purge button 130. In one example, the distal top 340 extends from the proximal top 330 with a sufficient length and has a sufficient width to cover the purge button 130 of the regulator 120 when the mouthpiece 110 is inserted into the hollow interior of the proximal portion of the body, while exposing a portion of the regulator 120 surrounding the purge button 130.

The side wall cut-outs 350 allow the fingers of the user or wearer of the vest or harness to grab or contact the regulator 120 (exposed by the side wall cut-outs 350) and pull the regulator 120 and the mouthpiece 110 out of the regulator cover device 300 by overcoming the friction fit of the mouthpiece 110 at the access opening 356 to the mouthpiece housing, between the distal portion and the proximal portion of the regulator cover device 300. Only one hand of the user is required to detach the mouthpiece 110 and regulator 120 from the regulator cover device 300. The user can do so by tactilely feeling the regulator 120 exposed by the side wall cut-outs 350 with fingers of the hand without the need to visually see the regulator 120.

Figure 12:
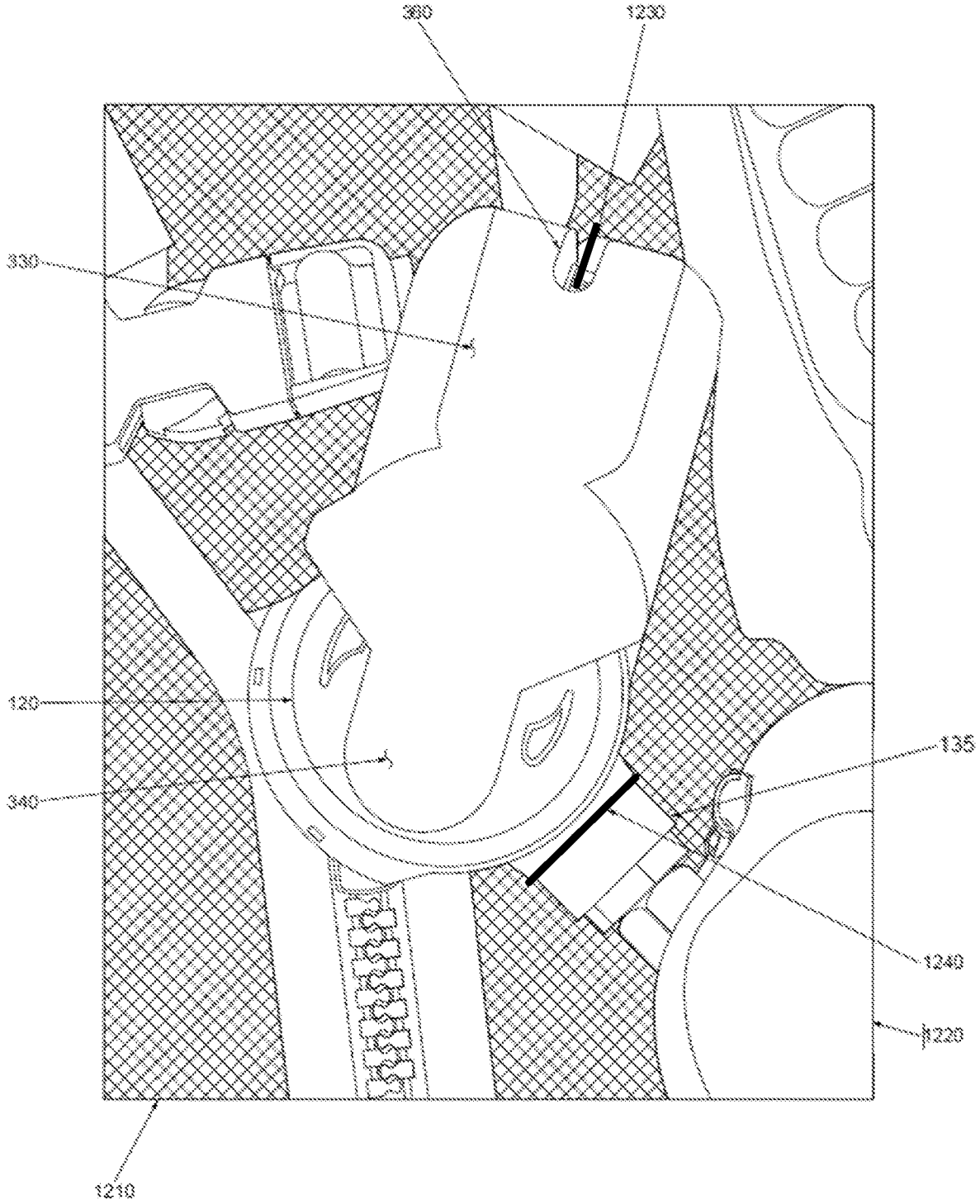
FIG. 12 is a view of the regulator cover device of FIG. 3 attached to a flight vest for use with an EBD.

FIG. 12 is a view of the regulator cover device of FIG. 3 attached to a flight vest for use with an EBD. The regulator cover device 300 is attached to an aircrew flight vest 1210. The regulator cover device 300 covers the mouthpiece 110 and the purge button 130 on the second stage regulator 120. The regulator 120 is connected via the hose connection 135 and the hose 140 to the cylinder 150 disposed in a cylinder pouch or pocket 1220 of the vest 1210. The regulator cover device 300 is attached to the flight vest 1210 using an attachment line 1230 that is inserted through the proximal slot 360 and the proximal column hole 640 and is then tied to a loop, ring, or the like on the flight vest 1210.

An additional feature involves the use of a readiness line or tamper line 1240 that ties the hose connection 135 (or the hose 140 near the hose connection 135) to the vest 1210 after the SEA device 100 is tested, checked, and ready for use. It is configured and tied in a way that the regulator 120 cannot be detached from the regulator cover device 300 without breaking or removing the tamper line 1240. For instance, the tamper line 1240 is tied tightly so that the regulator 120 cannot be detached from the regulator cover device 300 without breaking or removing the tamper line 1240. The tamper line 1240 is strong enough to avoid accidental breakage by a small force but is sufficiently weak that it breaks upon being stretched while the regulator 120 is being detached from the regulator cover device 300. A tamper line 1240 that has not been broken or removed can indicate that the SEA device 100 is checked and ready for use to prevent unnecessary purging that uses up the air stored in the cylinder 150. A tamper line 1240 that is intact can also indicate that the SEA device 100 has not been subjected to tampering.

The inventive concepts taught by way of the examples discussed above are amenable to modification, rearrangement, and embodiment in several ways. For example, this invention may be applicable in other environments not involving a flight vest. The shapes of the various parts of the regulator cover device may be modified while maintaining their functional aspects. Accordingly, although the present disclosure has been described with reference to specific embodiments and examples, persons skilled in the art will recognize that changes may be made in form and detail without departing from the spirit and scope of the disclosure.

An interpretation under 35 U.S.C. § 112(f) is desired only where this description and/or the claims use specific terminology historically recognized to invoke the benefit of interpretation, such as "means," and the structure corresponding to a recited function, to include the equivalents thereof, as permitted to the fullest extent of the law and this written description, may include the disclosure, the accompanying claims, and the drawings, as they would be understood by one of skill in the art.

To the extent the subject matter has been described in language specific to structural features or methodological steps, it is to be understood that the subject matter defined in the appended claims is not necessarily limited to the specific features or steps described. Rather, the specific features and steps are disclosed as example forms of implementing the claimed subject matter. To the extent headings are used, they are provided for the convenience of the reader and are not be taken as limiting or restricting the systems, techniques, approaches, methods, or devices to those appearing in any section. Rather, the teachings and disclosures herein can be combined or rearranged with other portions of this disclosure and the knowledge of one of ordinary skill in the art. It is intended that this disclosure encompass and include such variation.

The indication of any elements or steps as "optional" does not indicate that all other or any other elements or steps are mandatory. The claims define the invention and form part of the specification. Limitations from the written description are not to be read into the claims.

What is claimed is:

1. A cover device for a regulator which has a purge button and a mouthpiece connected to the regulator, the cover device comprising:

a body having a proximal portion and a distal portion, a base, a proximal end wall, a proximal top, two side walls spaced from one another in a width direction on two sides of the body, the proximal top, and the proximal end wall, and a distal top connected to the proximal top and being at a greater height than the proximal top relative to the base and being narrower in width than the proximal top;

the base, the proximal end wall, the proximal top, and the two side walls defining a hollow interior of the body in the proximal portion;

the two side walls configured to form, at a location between the proximal portion and the distal portion, a narrowed region of the hollow interior in the width direction providing a narrowed access to the hollow interior;

the proximal portion being sized to receive the mouthpiece into the hollow interior;

the narrowed region of the hollow interior between the two side walls to provide a friction fit configured to engage with the mouthpiece that enters and exits the hollow interior of the proximal portion; and the distal top extending from the proximal top with a sufficient length and having a sufficient width to cover the purge button of the regulator when the mouthpiece is inserted into the hollow interior of the proximal portion of the body.

2. The cover device of claim 1, wherein the base extends from the proximal portion to the distal portion; and wherein the distal top is narrower in width than the base in the distal portion and is shorter in length than the base in the distal portion in a distal direction extending from the proximal portion of the body away from the proximal end wall.

3. The cover device of claim 1, wherein the distal top has a proximal end connected to the proximal top and narrows in width from the proximal end to a distal end which is configured to generally match the purge button in width to cover the purge button.

4. The cover device of claim 1, wherein the two side walls extend from the proximal end wall in a distal direction toward the distal portion of the body and end at side wall cut-outs which are curved concave in shape and disposed between the base in the proximal portion of the body and the proximal top.

5. The cover device of claim 1, wherein the base extends from the proximal portion to the distal portion; and wherein the distal top is spaced from the base in the distal portion by a distance which is configured to be approximately equal to a height of the regulator between a bottom surface of the regulator and a top surface of the regulator which includes the purge button.

6. The cover device of claim 1, wherein the body comprises a proximal column at the proximal end wall extending from the base to a proximal column top, the proximal column including a proximal column hole therethrough between the base and the proximal column top;

wherein the proximal column top is disposed at a height below the proximal top relative to the base; and wherein the body comprises a proximal slot cut out of portions of the proximal end wall and the proximal top to expose the proximal column hole at the proximal column top between the proximal top and the base of the body.

7. A cover device for a regulator which has a purge button and a mouthpiece connected to the regulator, the cover device comprising a body which includes:

a mouthpiece housing to receive the mouthpiece through an access opening which presents a friction fit configured to squeeze the mouthpiece passing therethrough in a squeezed state to enter and exit a hollow interior of the mouthpiece housing, the hollow interior being configured to store the mouthpiece in a relaxed state; and a button cover connected to the mouthpiece housing to cover the purge button on a top surface of the regulator when the mouthpiece is inserted into the hollow interior of the mouthpiece housing;

the button cover being narrower in width than the mouthpiece housing of the body.

8. The cover device of claim 7, further comprising:

a regulator support connected to the mouthpiece housing to support a bottom surface of the regulator when the mouthpiece is inserted into the hollow interior of the mouthpiece housing;

wherein the button cover is at a greater height relative to the regulator support than a height of a top of the mouthpiece housing of the body relative to a base of the mouthpiece housing.

9. The cover device of claim 7, further comprising:

a regulator support connected to the mouthpiece housing to support a bottom surface of the regulator when the mouthpiece is inserted into the hollow interior of the mouthpiece housing;

wherein the button cover has a proximal end connected to the mouthpiece housing above the access opening of the mouthpiece housing and narrows in width from the proximal end to a distal end which is configured to generally match the purge button in width to cover the purge button.

10. The cover device of claim 9, wherein the regulator support has a proximal end connected to the mouthpiece housing below the access opening of the mouthpiece housing and has a distal end which is configured to generally match the bottom surface of the regulator in width.

11. The cover device of claim 10, wherein the mouthpiece housing includes two side cut-outs between the proximal end of the button cover and the proximal end of the regulator support, the two side cut-outs being disposed between the regulator support and the button cover and being curved concave in shape.

12. The cover device of claim 7, further comprising:

a regulator support connected to the mouthpiece housing to support a bottom surface of the regulator when the mouthpiece is inserted into the hollow interior of the mouthpiece housing;

wherein the button cover is spaced from the regulator support by a distance which is configured to be approximately equal to a height of the regulator between the bottom surface of the regulator and a top surface of the regulator which includes the purge button.

13. A method for covering a regulator which has a purge button and a mouthpiece connected to the regulator, using a cover device which includes a body having a mouthpiece housing to receive the mouthpiece through an access opening which presents a friction fit configured to squeeze the mouthpiece passing therethrough in a squeezed state to enter and exit a hollow interior of the mouthpiece housing, the hollow interior being configured to store the mouthpiece in a relaxed state; and a button cover connected to the mouthpiece housing; the method comprising:

inserting the mouthpiece into the hollow interior of the mouthpiece housing of the body by squeezing the mouthpiece from an open state to a collapsed state via the friction fit through the access opening to the hollow interior and allowing the mouthpiece to expand to the open state in the hollow interior of the mouthpiece housing; and covering the purge button on a top surface of the regulator with the button cover which extends from the mouthpiece housing with a sufficient length and a sufficient width to cover the purge button of the regulator.

14. The method of claim 13, wherein the cover device further includes a regulator support connected to the mouthpiece housing to support a bottom surface of the regulator when the mouthpiece is inserted into the hollow interior of the mouthpiece housing; and wherein the purge button is covered with the button cover which is narrower in width than the regulator support and is shorter in length than the regulator support in a direction extending from the mouthpiece housing of the body.

15. The method of claim 14, wherein the cover device further includes a regulator support connected to the mouthpiece housing to support a bottom surface of the regulator when the mouthpiece is inserted into the hollow interior of the mouthpiece housing; and wherein the purge button is covered with the button cover which has a proximal end connected to the mouthpiece housing above the access opening of the mouthpiece housing and narrows in width from the proximal end to a distal end which generally matches the purge button in width to cover the purge button.

16. The method of claim 15, wherein the regulator support has a proximal end connected to the mouthpiece housing below the access opening of the mouthpiece housing and has a distal end which generally matches the bottom surface of the regulator in width;

wherein the mouthpiece housing includes two side cut-outs between the proximal end of the button cover and the proximal end of the regulator support, the two side cut-outs being disposed between the regulator support and the button cover and being curved concave in shape; and wherein the method further comprises contacting the regulator exposed by the two side cut-outs by a user's hand to pull the regulator and the mouthpiece out of the body of the cover device by overcoming the friction fit of the mouthpiece at the access opening to the hollow interior of the mouthpiece housing.

17. The method of claim 16, wherein the user's hand contacts the regulator by tactilely feeling the regulator exposed by the two side cut-outs with fingers of the user's hand without a need for the user to visually see the regulator.

18. The method of claim 13, wherein the mouthpiece housing comprises a column spaced from the access opening and including a column hole through a length of the column; and wherein the method further comprises attaching the body of the cover device to a garment to be worn by a user by inserting an attachment line through the column hole and tying the attachment line to the garment.

19. The method of claim 13, wherein the mouthpiece housing comprises a column spaced from the access opening and including a column hole through a length of the column;

wherein the mouthpiece housing comprises a slot cut into the hollow interior to expose the column hole on one end of the column; and wherein the method further comprises attaching the body of the cover device to a garment to be worn by a user by inserting an attachment line via the slot through the column hole and tying the attachment line to the garment.

20. The method of claim 13, further comprising:

connecting the regulator via a hose connection and a hose to a cylinder of an air supply device disposed in a cylinder pouch of a garment to be worn by a user; and tying a tamper line between the hose connection or the hose adjacent the hose connection and the garment after the air supply device is tested, checked, and ready for use, the tamper line being tied in a way that the regulator cannot be detached from the cover device without breaking or removing the tamper line.

* * * * *